US005335909A

United States Patent [19]

Green, Jr.

[11] Patent Number: 5,335,909

[45] Date of Patent: Aug. 9, 1994

[54] WOOD HEAD NO HOSEL GOLF CLUB

[76] Inventor: Robert Green, Jr., 9041 Puesta Del Sol, Desert Hot Springs, Calif. 92240

[21] Appl. No.: 47,180

[22] Filed: Apr. 16, 1993

[51] Int. Cl.[5] ..... A63B 53/02

[52] U.S. Cl. ..... 273/80.2; 273/80.4; 273/80.8; 273/167 K

[58] Field of Search ..... 273/80.1, 80.2, 80.3, 273/80.4, 80.5, 80.6, 80.7, 80.8, 0.9, 167 K, 77 R

[56] References Cited

U.S. PATENT DOCUMENTS

| | | | |
|---|---|---|---|
| 1,601,770 | 10/1926 | Reach | 273/80.4 |
| 1,644,510 | 10/1927 | Buhrke | 273/80.3 |
| 1,787,415 | 12/1930 | Washington | 273/80.8 |
| 1,983,069 | 12/1934 | Cowdery | 273/80.3 |
| 2,020,679 | 11/1935 | Fitzpatrick | 273/80.4 |
| 2,039,320 | 5/1936 | Kraeuter | 273/80.5 |
| 2,880,002 | 3/1959 | Wetty | 273/167 K |

FOREIGN PATENT DOCUMENTS

| | | | |
|---|---|---|---|
| 26072 | of 1912 | United Kingdom | 273/80.2 |
| 363634 | 12/1931 | United Kingdom | 273/80.3 |
| 2144042 | 2/1985 | United Kingdom | 273/80.8 |

*Primary Examiner*—Jessica J. Harrison
*Assistant Examiner*—Sebastiano Passaniti
*Attorney, Agent, or Firm*—I. Louis Wolk

[57] ABSTRACT

A wood head golf club is described in which the usual hosel is eliminated and provision is made for anchoring the graphite or other shaft within the club head within a rigid sleeve positioned therein, thus eliminating the objectional degree of rigidity imparted by the use of a hosel which extends beyond the clubhead. As a result a greater degree of flex and torque is obtainable from the shaft. The sleeve is preferably formed with an outwardly tapering shoulder which provides a space for cushioning material between shaft and shoulder.

6 Claims, 1 Drawing Sheet

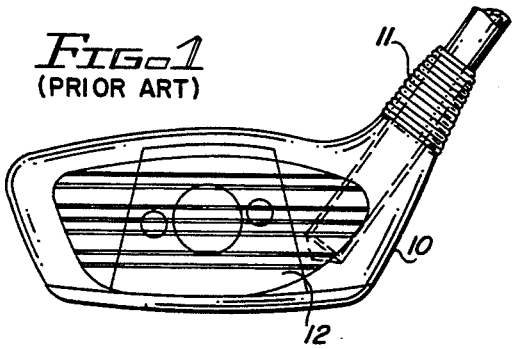
FIG. 1
(PRIOR ART)
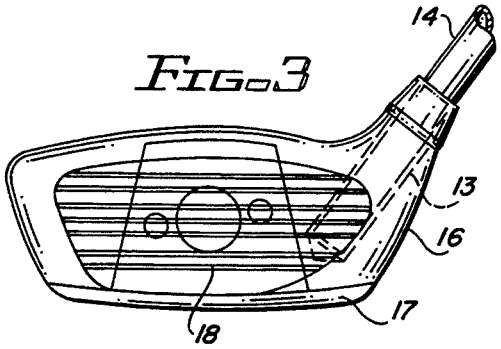
FIG. 3
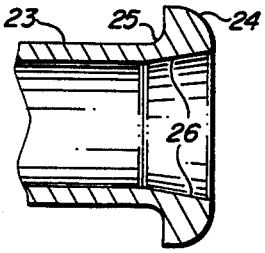
FIG. 8
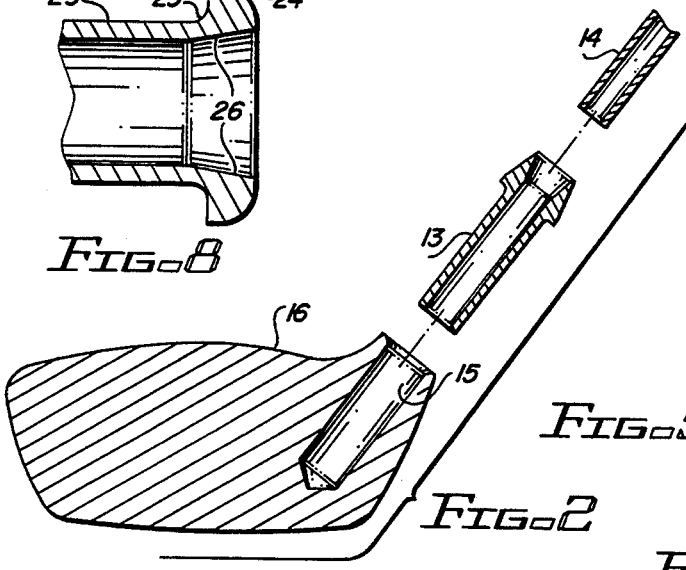
FIG. 2
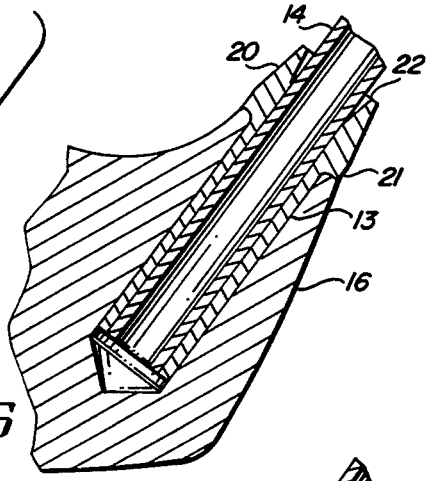
FIG. 5
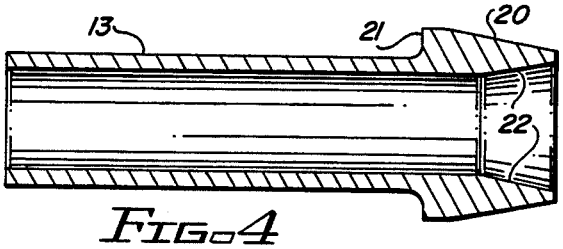
FIG. 4
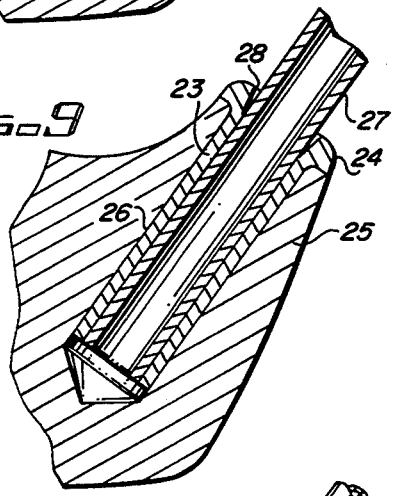
FIG. 9
FIG. 4a
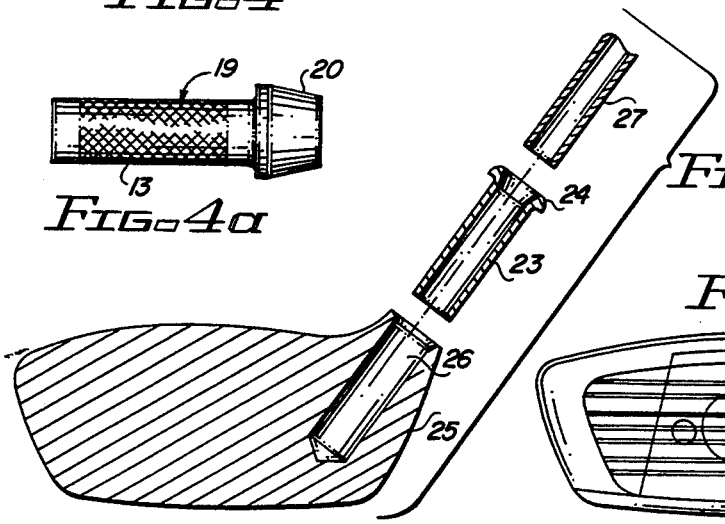
FIG. 6
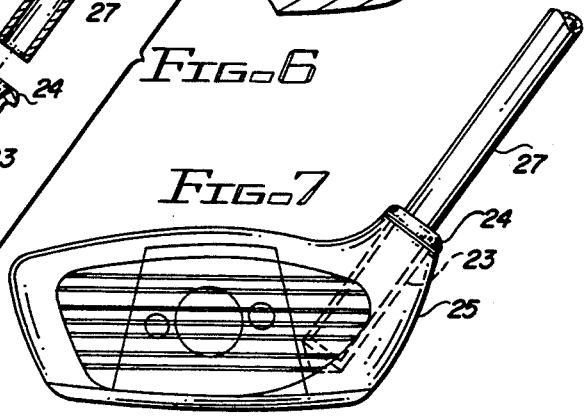
FIG. 7

WOOD HEAD NO HOSEL GOLF CLUB

This invention relates to a wood head golf club having a graphite or metal shaft in which the top portion of the shaft is firmly engaged by the head without the necessity for an elongated hosel. In this manner end or top portion of the shaft can flex and provide a desired degree of torque to the club head upon impact.

BACKGROUND OF THE INVENTION

Conventional wood head golf clubs are designed so that the tip or end of the shaft enters the clubhead directly and is bonded therein, but in order to ensure firm engagement of the shaft with the club, the head is formed with an elongated hosel extending upwardly from the head for a distance of several inches, said shaft end extending through the hosel into the head and being firmly bonded thereto. This has hitherto been thought necessary to provide the necessary degree of strength to retain the tip in engagement with the club head since otherwise the shaft tip would become disengaged.

As a result of this arrangement, the tip portion of the shaft is embedded in the clubhead but in addition several additional inches of shaft are required to be embedded and surrounded by the length of the hosel with the result that a substantial portion of the shaft end beyond the tip is made inflexible with the result that any flex or torque which might otherwise be imparted to the clubhead by tip action is nullified to a large extent.

SUMMARY OF THE INVENTION

Applicant has discovered that by the elimination of the elongated hosel and insertion of a metallic sleeve into the clubhead designed to engage and become bonded to the shaft tip, the tip itself can be retained within the sleeve and the clubhead with sufficient strength and rigidity while at the same time permitting the shaft to exert the full amount of tip action for which the shaft is designed.

Because of the greater tip flexibility it is found that the player obtains a greater degree of accuracy, feel and confidence with use of the club.

The shaft manufacturer gains full playability and performance from the shaft due to a greater response in flex and torque by the elimination of the restraint imposed by the elongated hosel.

In addition, the total weight of the clubhead is reduced contributing to lightness and more clubhead speed.

With this design, the wood club may be made longer which can give the player greater distance by increasing the arc of the swing and clubhead speed.

BRIEF DESCRIPTION OF THE DRAWINGS

As shown in the drawings:

FIG. 1 is a view in perspective of a typical wood head of the prior art with its elongated hosel.

FIG. 2 is a view in cross section of a clubhead and shaft end of the invention showing the parts in exploded or separated manner prior to assembly.

FIG. 3 is a front view of a clubhead and shaft end of the invention after assembly.

FIG. 4 is a view in longitudinal transverse cross section of one form of the sleeve insert which replaces the hosel.

FIG. 4*a* is a view in perspective of the sleeve of FIG. 4 showing a desired knurling on the body thereof.

FIG. 5 is a view in cross section showing the sleeve of FIG. 4 as inserted into the clubhead with the shaft tip inserted therein.

FIG. 6 is an exploded view in cross section of a clubhead and shaft and showing another form of the sleeve prior to assembly.

FIG. 7 is a front view of the club of FIG. 6 showing the assembly in dotted lines.

FIG. 8 is a partial cross section of a sleeve which is a variant of FIG. 4.

FIG. 9 is a view in cross section of the sleeve of FIG. 8 inserted into a clubhead with the tip of the shaft in position.

DETAILED DESCRIPTION OF THE INVENTION

A typical wood club 10 of conventional construction is shown in FIG. 1, wherein the body and extended hosel 11 are formed of wood with the face 12 provided with plastic or metal inserts. In similar clubs the hosel portion itself may be tightly wound with cord to provide greater rigidity.

FIGS. 2, 3, 4, 4*a* and 5 illustrate applicant's invention in which the hosel is substantially or completely eliminated and the principal support for the tip of the shaft only is provided by means of a metal sleeve 13 which is dimensional to fit the tip end of shaft 14 after insertion into cylindrical opening 15 formed through the neck of clubhead 16 as shown in FIG. 2 and 3. Opening 15 is coextensive with the opening formed to accommodate the tip of the shaft which would extend through the hosel and downward in alignment therewith to a point near the base of the clubhead. In FIG. 3, the assembly is shown in a wood clubhead having a base plate 17 and face inserts 18.

During assembly the sleeve 13 is cemented into position in opening 15 using an epoxy or other suitable cement. Thereafter shaft 14 is similarly cemented in position. As shown in FIG. 4*a*, the sleeve is preferably knurled as at 19 to improve adhesion.

A preferred structure of the sleeve is shown in FIG. 4 in which the sleeve is formed of rigid metal such as aluminum. Other metals such as steel, brass, etc. may be used. Rigid plastics may also be found to be suitable. The body portion which is inserted through the neck of the club as shown in enlarged detail in FIG. 5 is formed at its upper end with a collar 20, the shoulder 21 of which is shaped at its position of engagement with the clubhead with a slight curve or contour to conform to the usual rounded edge of the neck opening to the clubhead. The opening of the collar is formed with a slight outward taper as shown at 22 to provide a slight angular space 22 between the shaft and the collar around the area between the shaft and sleeve end. This area becomes filled with the plastic or solidified adhesive and acts as a cushion between the collar opening and the shaft to prevent possible breakage which may result from friction between shaft and collar at that point. A preferred angle is about 10° to the vertical, at the inner edge which results in an overall taper of 20°. The angle is not critical but can be selected to accomplish the purpose of providing a slight barrier for the purpose described.

The dimensions of the sleeve are determined by such factors as the size of the clubhead, the length of opening in the head for insertion of the shaft and the diameter of the shaft itself. In one specific application, the sleeve has a length to the base of the collar of 1.375", the collar length is 0.438", the O.D. is 0.432", the I.D. is 0.335", the opening at the collar end is 0.423".

FIGS. 6, 7, 8 and 9 illustrate the same type of sleeve 23 which is formed with a modified collar 24 which is in the shape of a curved rim as shown. In FIG. 8, the principal difference is that the taper at the end is shorter but at the same angular degree.

FIG. 6 shows the sleeve assembly separated manner prior to assembly into clubhead 25 showing opening 26 sleeve 23, rim 24 and shaft 27.

FIG. 7 shows the assembled clubhead with the sleeve and shaft in assembled position.

As shown in greater detail in FIGS. 8 and 9 sleeve 23 is formed with a shoulder 25 having a rounded contour to provide a close fit to conform to the edge of the opening in the clubhead, and a rounded rim 24 designed to provide a tapered opening 26 in which the degree of taper is selected as desired, say 20° as shown.

In FIG. 9, the assembled position of the sleeve and shaft is shown in enlarged section, with sleeve 23 cemented into position in opening 26 and shaft 27 cemented within the sleeve and rim 24 in engagement with the opening in the neck of clubhead 25.

As shown at 28 the taper at the opening provides a small area for the plastic cement to provide a non-metallic cushioning at the points of contact of the shaft with the rim at edge of the sleeve protecting against possible shaft fracture. The club obtained as described above is one in which the hosel or the necessity therefor has been eliminated. This avoids the disadvantage of having an elongated rigid extension at the lower end of the shaft above the neck of the clubhead which prevents the desired flex and torque obtainable by eliminating this added rigidity, while the sleeve as shown incorporates a short collar with a shoulder in engagement with the clubhead, this collar is so short that it does not impart any undesirable rigidity. In use the length of such collar would be less than an inch and in the example described less than ½ inch. In addition, provision of the outward flare or taper provides the cushioning area described between the shaft and the collar.

I claim:

1. A wood golf club requiring no hosel and having a club head with a neck portion at a top of the head and a base portion at a bottom of the head, a cylindrical opening extending from said neck portion downward to a point adjacent to but spaced from said base portion, a rigid cylindrical sleeve positioned within and cemented to said opening, said sleeve having a shoulder and collar in engagement with and surrounding said neck portion, an elongated club shaft, a lower end of which is positioned within said sleeve and cemented therein, said collar being formed with an outwardly tapering opening which is greater in diameter than both a inner diameter of said sleeve and an outer diameter of said shaft, a space provided between said shaft and said opening, and cushioning material between said shaft and said collar.

2. A wood golf club according to claim 1 wherein the surface of the sleeve is knurled to promote adhesion.

3. A wood golf club according to claim 1 wherein the sleeve is formed of aluminum.

4. A wood golf club according to claim 1 wherein the collar is in the form of an upwardly extending outwardly tapering relatively short portion extending beyond the neck of said clubhead.

5. A wood golf club according to claim 4 wherein the collar is in the form of an outwardly tapered upward extension.

6. A wood golf club according to claim 4, wherein the collar is in the form of a rounded rim, an inner surface of which tapers outwardly from said shaft.

* * * * *